US008888725B2

(12) United States Patent
Parascandola et al.

(10) Patent No.: US 8,888,725 B2
(45) Date of Patent: Nov. 18, 2014

(54) MECHANICAL CHEST COMPRESSION PLUNGER ADAPTER AND COMPRESSION PAD

(71) Applicant: ZOLL Medical Corporation, Chelmsford, MA (US)

(72) Inventors: Michael Parascandola, Chelmsford, MA (US); Gary Freeman, Chelmsford, MA (US)

(73) Assignee: ZOLL Medical Corporation, Chelmsford, MA (US)

( * ) Notice: Subject to any disclaimer, the term of this patent is extended or adjusted under 35 U.S.C. 154(b) by 126 days.

(21) Appl. No.: 13/629,434

(22) Filed: Sep. 27, 2012

(65) Prior Publication Data

US 2014/0088467 A1 Mar. 27, 2014

(51) Int. Cl.
*A61H 31/00* (2006.01)
*A61H 31/02* (2006.01)

(52) U.S. Cl.
CPC ..... *A61H 31/00* (2013.01)
USPC ..... 601/41; 601/44

(58) Field of Classification Search
USPC ..... 601/41–44, 107–111
See application file for complete search history.

(56) References Cited

U.S. PATENT DOCUMENTS

| | | | | |
|---|---|---|---|---|
| 4,770,164 | A | 9/1988 | Lach et al. | |
| 5,738,637 | A | 4/1998 | Kelly et al. | |
| 6,066,106 | A | 5/2000 | Sherman et al. | |
| 6,142,962 | A | 11/2000 | Mollenauer et al. | |
| 6,398,745 | B1 | 6/2002 | Sherman et al. | |
| 6,616,620 | B2 | 9/2003 | Sherman et al. | |
| 7,226,427 | B2 | 6/2007 | Steen | |
| 7,569,021 | B2 | 8/2009 | Sebelius et al. | |
| 2004/0116840 | A1 | 6/2004 | Cantrell et al. | |
| 2008/0300518 | A1 * | 12/2008 | Bowes | 601/41 |
| 2009/0260637 | A1 | 10/2009 | Sebelius et al. | |
| 2010/0004571 | A1 | 1/2010 | Nilsson et al. | |
| 2010/0004572 | A1 | 1/2010 | King | |
| 2010/0185127 | A1 | 7/2010 | Nilsson et al. | |
| 2011/0201979 | A1 | 8/2011 | Voss et al. | |

* cited by examiner

*Primary Examiner* — Justine Yu
*Assistant Examiner* — Kathrynn Reilly
(74) *Attorney, Agent, or Firm* — K. David Crockett, Esq.; Paul J. Backofen, Esq.; Crockett & Crockett, PC

(57) ABSTRACT

A plunger adapter and a detachable compression pad for piston driven chest compression devices optimizes the application of chest compressions to a fixed location on a patient's chest. The detachable compression pad may be removably secured to the patient above the patient's sternum to ensure that the compression pressure from the piston through the piston adapter is applied to a fixed location on the patient's chest. As the plunger and plunger adapter retract from the chest, the compression pad remains fixed to the patient's chest, and as the plunger and plunger adapter extend from the chest compression unit for subsequent compression strokes, the distal end of the plunger adapter reengages the compression pad to apply compression to a fixed location on the patient's chest.

3 Claims, 5 Drawing Sheets

MECHANICAL CHEST COMPRESSION PLUNGER ADAPTER AND COMPRESSION PAD

FIELD OF THE INVENTIONS

The inventions described below relate to the field of emergency medical devices and methods and more specifically to methods and device to optimize the resuscitation of cardiac arrest patients.

BACKGROUND OF THE INVENTIONS

According to the American Heart Association nearly 383,000 out-of-hospital sudden cardiac arrests occur annually in the United States. These patients may be saved by the timely application of life saving measures such as Cardiopulmonary resuscitation (CPR).

CPR is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask device, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., Decay In Quality Of Chest Compressions Over Time, 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended chest compression efforts (45 to 90 minutes) have been reported, with the victims eventually being saved by coronary bypass surgery. See Tovar, et al., Successful Myocardial Revascularization and Neurologic Recovery, 22 Texas Heart J. 271 (1995).

In efforts to provide better blood flow and increase the effectiveness of bystander resuscitation efforts, various mechanical devices have been proposed for performing AUTOMATED CHEST COMPRESSIONS. In one variation of such devices, a belt is placed around the patient's chest and the belt is used to effect chest compressions. Our own patents, Mollenauer, et al., Resuscitation Device having a Motor Driven Belt to Constrict/Compress the Chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman, et al., Modular CPR Assist Device, U.S. Pat. No. 6,066,106 (May 23, 2000); and Sherman, et al., Modular CPR Assist Device, U.S. Pat. No. 6,398,745 (Jun. 4, 2002), and our application Ser. No. 09/866,377 filed on May 25, 2001, show chest compression devices that compress a patient's chest with a belt. Various other mechanisms may be used to tighten the belt, including the mechanisms shown in Lach, et al., Resuscitation Method and Device, U.S. Pat. No. 4,774,160 (Sep. 13, 1988) and in Kelly, et al., Chest Compression Device for Cardiac Arrest, U.S. Pat. No. 5,738,637 (Apr. 14, 1998).

Piston based chest compression systems are illustrated in Nilsson, et al., CPR Device and Method, U.S. Patent Publication 2010/0185127 (Jul. 22, 2010), Sebelius, et al., Support Structure, U.S. Patent Publication 2009/0260637 (Oct. 22, 2009), Sebelius, et al., Rigid Support Structure on Two Legs for CPR, U.S. Pat. No. 7,569,021 (Aug. 4, 2009), Steen, Systems and Procedures for Treating Cardiac Arrest, U.S. Pat. No. 7,226,427 (Jun. 5, 2007) and King, Gas-Driven Chest Compression Device, U.S. Patent Publication 2010/0004572 (Jan. 7, 2010) all of which are hereby incorporated by reference.

As mechanical compressions are performed by piston based chest compression systems, the compression pads may shift position relative to the patient and the effectiveness of the automated chest compressions are diminished. The repeated extension and retraction of the piston often results in the piston and compression cup moving or "walking" up the patient's chest toward the neck or moving down toward the patient's abdomen.

SUMMARY

The devices and methods described below provide for a plunger adapter and a detachable compression pad for piston driven chest compression devices that maintain the compression force in the proper position on the patient's chest. The detachable compression pad is removably secured to the patient above the patient's sternum to ensure that the compression pressure from the piston through the piston adapter is applied to a fixed location on the patient's chest. As the piston and piston adapter retract from the chest, the compression pad remains fixed to the patient's chest, and as the piston and piston adapter extend from the chest compression unit, the distal end of the plunger adapter reengages the compression pad to apply compression to the patient's chest at the same location above the patient's sternum as the previous compressions.

Any suitable set of corresponding shapes may be provided in the plunger adapter and compression pad to minimize movement of the compression pad relative to the patient's chest and to optimize application of compressive force to the patient's chest. Complementary convex and concave shapes on the plunger adapter and the compression pad enable the plunger adapter and the compression pad to engage and focus the compression force to the patient's chest for each extension of the plunger. In a more detailed example, the distal end of the plunger adapter may have a conical or frusto-conical socket and the compression pad may include a corresponding conical or frusto-conical portion or extension on the proximal end to engage the socket in the plunger adapter. The plunger adapter socket and the compression pad extension will adapt any round, ovoid or spherical shape to provide positive engagement while avoiding any rotational forces generated by the plunger about the long axis of the plunger. By securing the compression pad to the patient's chest, the application of compressive force is maintained in the selected location.

The compression pad is a generally incompressible pad configured to adapt to the shape of the patient's chest. The compression pad may be formed of one or more layers to optimize the application of CHEST COMPRESSIONS to the patient. The proximal or upper end of the compression pad is a generally hard convex portion or extension that may include a concave socket for engaging the plunger adapter. The central layer may be a flexible and incompressible layer to conform to the shape of the patient's chest. The lower or distal end of the compression pad may include one or more flexible cups for creating one or more areas of vacuum between the compression pad and the patient's chest.

Suitable engagement mechanisms may be included in the plunger and the plunger adapter to provide a preselected level of chest expansion force in addition to chest compression force. A magnet may be provided in the distal end of the plunger and a corresponding magnet or ferrous material may be included in the proximal end of the plunger adapter to provide a preselected retention force between the plunger and the plunger adapter. The retention force is selected to provide some expansion force to the patient's chest between compressions without applying enough expansion force to the patient's chest to tear the patient's skin or underlying tissue. Similarly an electromagnet may be provided in distal end of the plunger to provide an adjustable level of retention force, or to provide timed release of the plunger adapter from the plunger.

DETAILED DESCRIPTION OF THE INVENTIONS

Figure 1:
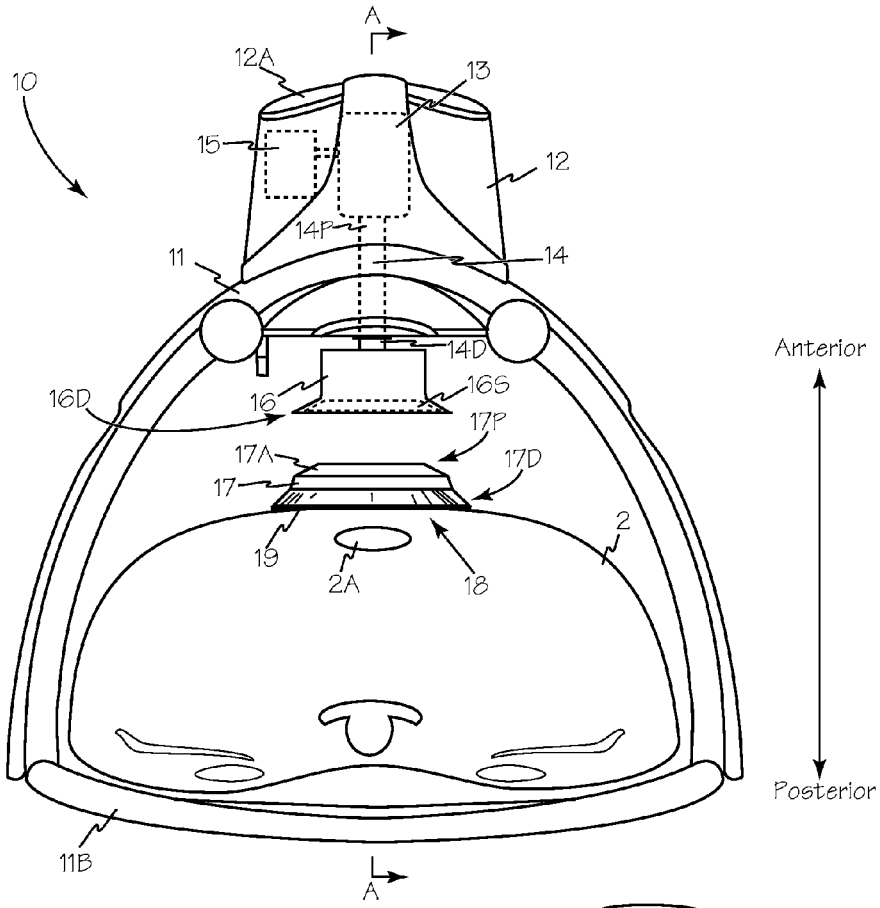
FIG. 1 is a front view of a piston driven chest compression device with a detachable plunger adapter and compression pad and a cross section of a patient's chest showing landmark skeletal structures.

In FIG. 1, mechanical chest compression device 10 is oriented to apply compressions to the chest 2 of patient 1. Chest compression device 10 includes support structure 11 and backboard 11B which supports and orients chest compression unit 12 apposing sternum 2A. Chest compression unit 12 includes any suitable drive means such as motor 13 which may be a reversible electromotor, a linear actuator or the like. Plunger 14 has a distal end 14D and a proximal end 14P, and proximal end 14P of the plunger is operably coupled to motor 13. Distal end 14D of the plunger extends from and withdraws into the housing upon operation of motor 13. A motor control unit such as controller 15 is operably connected to motor 13 and includes a microprocessor to control the operation of the motor and the plunger. Plunger adapter 16 is secured to the distal end of the plunger and compression pad 17 removably engages the plunger adapter.

Distal end 16D of plunger adapter 16 is sized and shaped to avoid injury to a patient if plunger 14 is extended to contact the patient without a compression pad between the plunger adapter and the patient. Distal end 16D of plunger adapter 16 includes a socket 16S that is sized and shaped to engage a correspondingly shaped element on a compression pad which may be called a key, a portion or an extension such as extension 17A on proximal end 17P of compression pad 17. Compression pad extension 17A operates as a locator pin or key for preventing the locator bushing, plunger adapter 16, and chest compression unit 12 from changing the point of application of compression force on the patient or "walking" across the patients chest.

Figure 2:
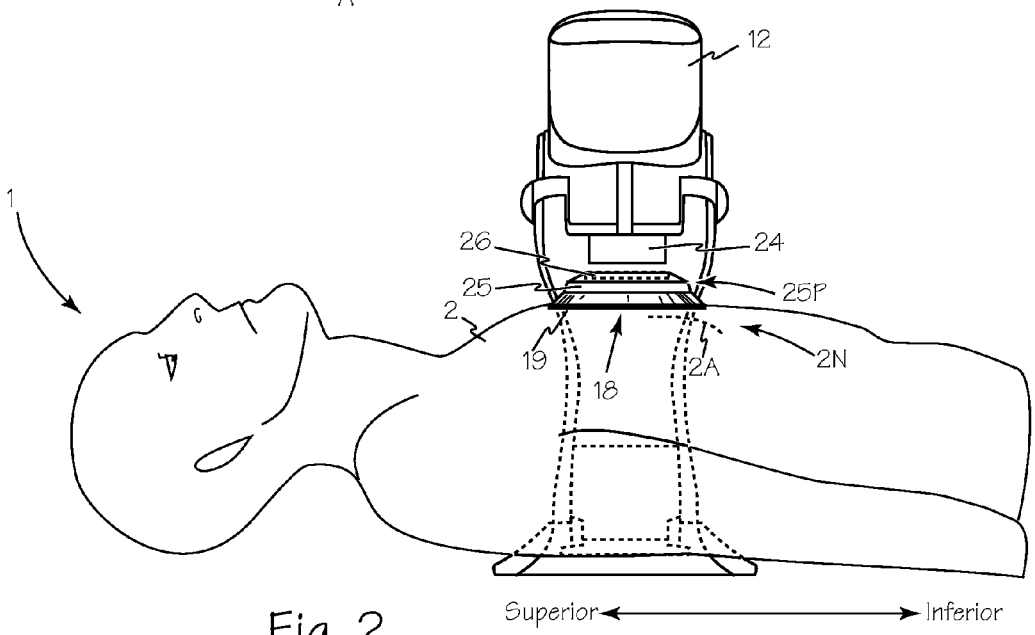
FIG. 2 is a cross section of the chest compression device of FIG. 1 taken along A-A with an alternate plunger adapter and compression pad.

In use, compression pad 17 is removably secured to the patient's chest at force application location 18, which is in a superior position relative to sternal notch 2N as illustrated in FIG. 2. Compression pad 17 may be secured to the patient with any suitable biocompatible tape or adhesive such as adhesive 19. The mechanical chest compression device 10 is oriented around the patient's chest 2 with chest compression unit 12 apposing compression pad 17. Plunger 14 is extended to confirm proper siting of compression pad 17 on the patient and to confirm mating and orientation of plunger adapter 16 with compression pad 17 and compression pad extension 17A with socket 16S. Upon confirmation of proper alignment and orientation, controller 15 is instructed, through any suitable interface such as interface 12A, to perform cyclic compressions and decompressions for CPR.

As illustrated in FIG. 2, plunger adapter 24 is configured with a generally cylindrical shape. Compression pad 25 includes a corresponding cylindrical shaped socket 26 in proximal end 25P of compression pad 25. In configurations with the plunger adapter operating as the male component in the plunger adapter/compression pad interface, the plunger adapter should be sized such that the force per unit area applied by the plunger adapter, if applied directly to the patient's chest, does not damage the patient.

The combination of plunger adapter and compression pad may be sized along the anterior-posterior axis to enable a chest compression unit with a fixed length plunger with a fixed extension length to accommodate patients with different anterior-posterior dimensions.

Figure 3:
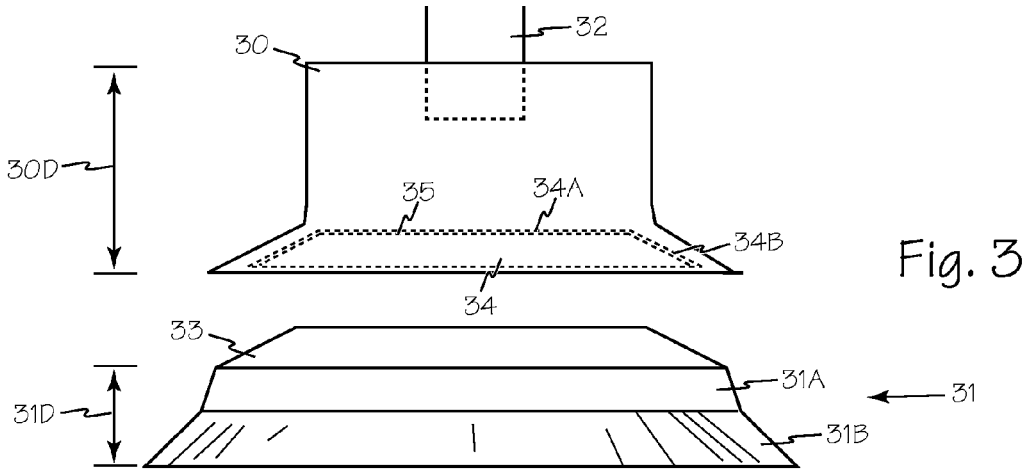
FIG. 3 is a side view of a plunger adapter and compression pad.
Figure 4:
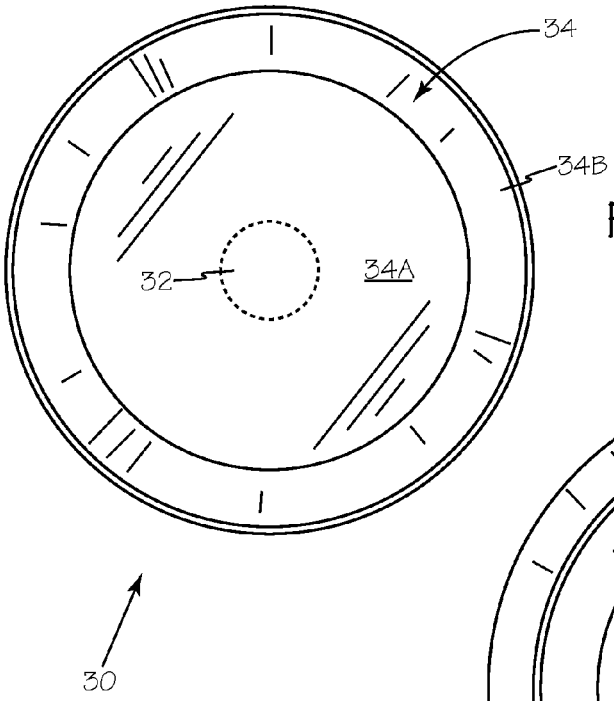
FIG. 4 is an end view of the distal end of a plunger adapter with a frusto-conical socket.
Figure 5:
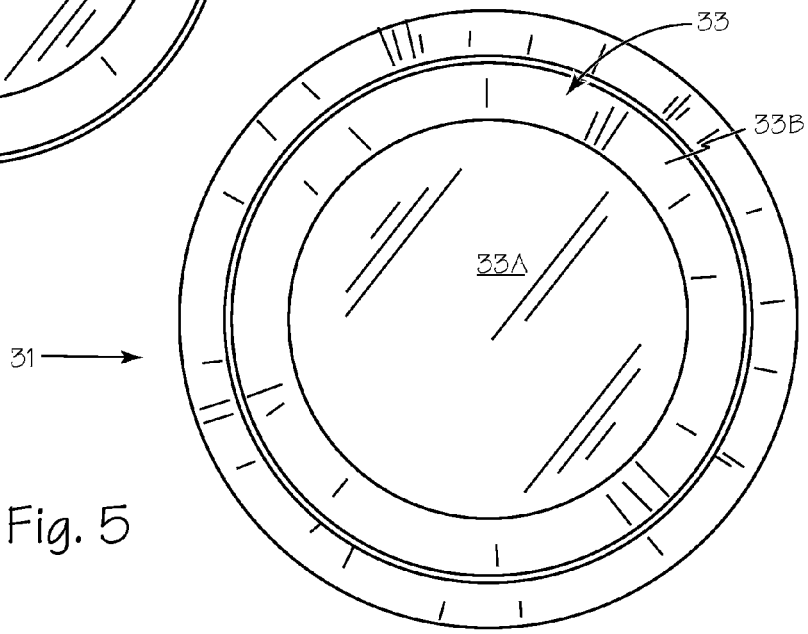
FIG. 5 is an end view of the proximal end of a compression pad with an extension corresponding to the frusto-conical socket of the plunger adapter of FIG. 4.

In FIGS. 3, 4 and 5, plunger adapter 30 has a height or anterior posterior dimension 30D and compression pad 31 has a height or anterior posterior dimension 31D. Plunger adapter 30 is removably secured to plunger 32 using any suitable technique such as mating threads, keyed slots, locator pin or pins, friction engagement or other. The height of a plunger adapter and the height of a compression pad may be individually selected to conform to the anterior posterior dimensions of a patient and the length and extension capability of a plunger and compression unit. Compression pad 31 includes extensions such as extension 33 sized to engage a comparably sized socket such as socket 34 in any suitable plunger adapter such as plunger adapter 30. The inner surfaces, surface 34A and surface 34B, of a plunger adapter socket such as socket 34 may include an adhesive or coating such as adhesive layer 35 with a preselected level of adhesion to maintain a limited engagement between a plunger adapter, such as adapter 30, and a compression pad such as compression pad 31, to produce a preselected level of decompression during each retraction of the plunger while performing automated chest compressions with minimal damage to the patient. Adhesive layer 35 may also be applied to compression pad surfaces 33A and or 33B.

Compression pad 31 is a generally incompressible pad configured to adapt to the shape of the patient's chest. A compression pad such as compression pad 31 may be formed of one or more layers such as first layer 31A and second layer 31B to optimize the application of compressive force to the patient. The proximal or upper end of the compression pad is a generally hard extension or socket such as extension layer 33 for engaging the plunger adapter. The first or central layer, layer 31A may be a flexible and incompressible layer to conform to the shape of the patient's chest. The lower or distal end, second layer 31B, of the compression pad is flexible and generally incompressible to adapt to the shape of the patient's chest and may include one or more flexible cups for creating one or more areas of vacuum between the compression pad and the patient's chest.

Suitable engagement mechanisms may be included in the plunger and the plunger adapter to provide a preselected level of chest expansion force in addition to chest compression force. A magnet may be provided in the distal end of the plunger and a corresponding magnet or ferrous material may be included in the proximal end of the plunger adapter to provide a preselected retention force between the plunger and the plunger adapter. The retention force is selected to provide some expansion force to the patient's chest between compressions without applying enough expansion force to the patient's chest to tear the patient's skin or underlying tissue. Similarly an electromagnet may be provided in distal end of the plunger to provide an adjustable level of retention force, or to provide timed release of the plunger adapter from the plunger.

Figure 6:
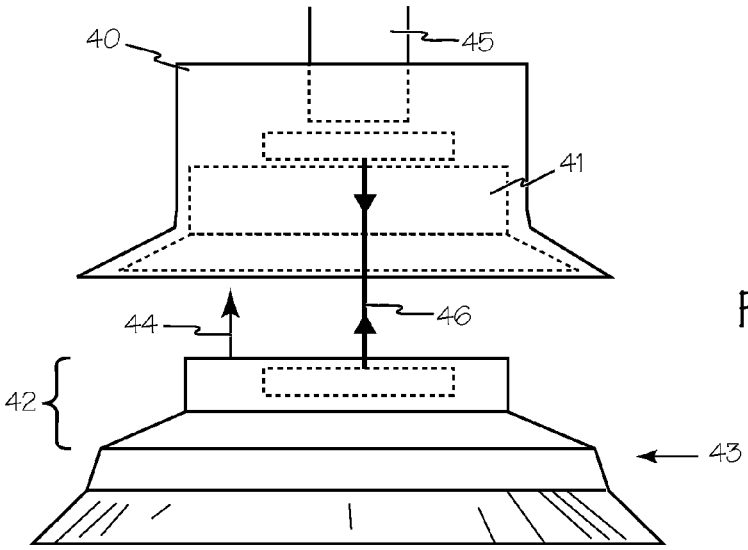
FIG. 6 is a side view of an alternate plunger adapter and compression pad.
Figure 7:
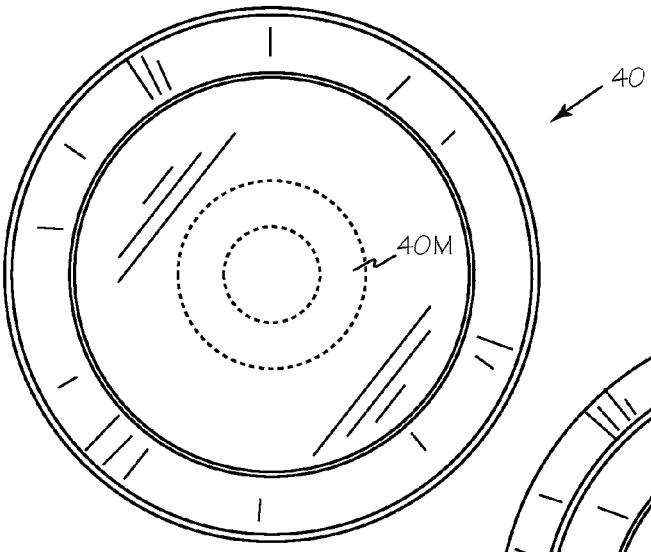
FIG. 7 is an end view of the distal end of the plunger adapter of FIG. 6.
Figure 8:
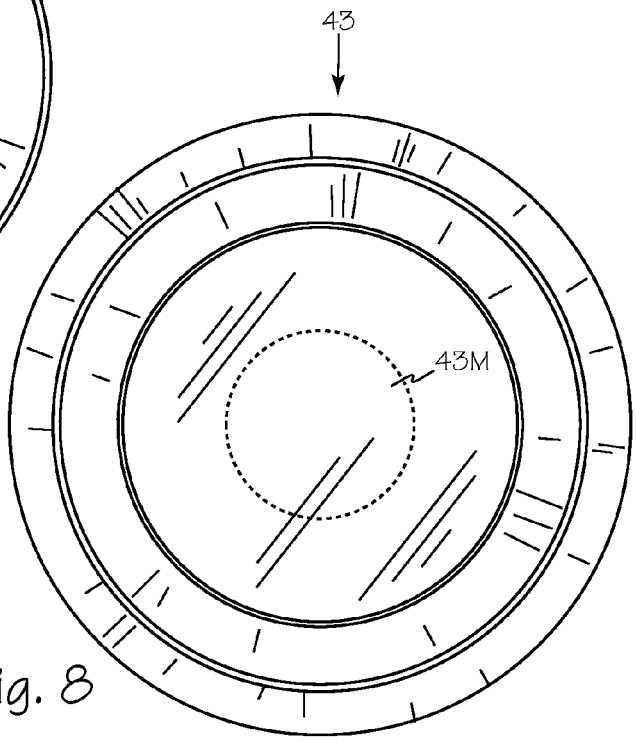
FIG. 8 is an end view of the proximal end of a compression pad with an extension corresponding to the plunger adapter of FIG. 6.

As illustrated in FIGS. 6, 7 and 8, plunger adapter 40 includes socket 41 that is sized and dimensioned to engage extension 42 of compression pad 43. Compression pad 43 may be removably secured to the chest of a patient as discussed above. To generate a predetermined decompression force 44 during the retraction of plunger 45, magnets such as adapter magnet 40M and compression magnet 43M may be included in plunger adapter 40 and compression pad 43 to provide the predetermined retention force, such as force of attraction or magnetic force 46, to hold compression pad 43 to plunger adapter 40 until the predetermined decompression force is exceeded. The predetermined level of decompression force is selected to be at a level below which, the chest tissue at force application location 18 will not be damaged before compression pad 43 releases from plunger adapter 40. Any other suitable technique for providing a predetermined level of retention force 46 may be used such as electromagnetic attraction, frictional engagement or others. Any other suitable cooperative configurations of socket and extension may be used.

Figure 9:
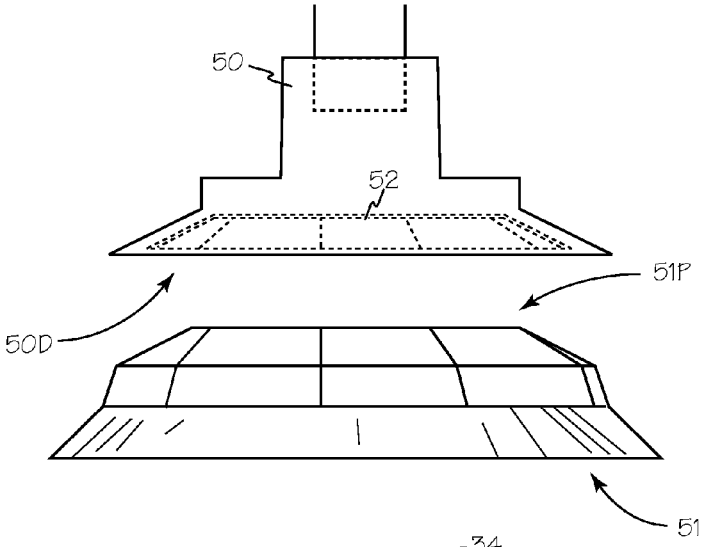
FIG. 9 is a side view of an octagonal plunger adapter and compression pad.
Figure 10:
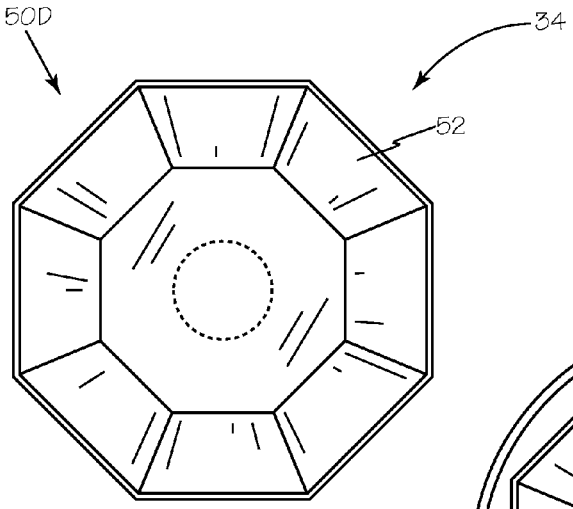
FIG. 10 is an end view of the distal end of the plunger adapter of FIG. 9.
Figure 11:
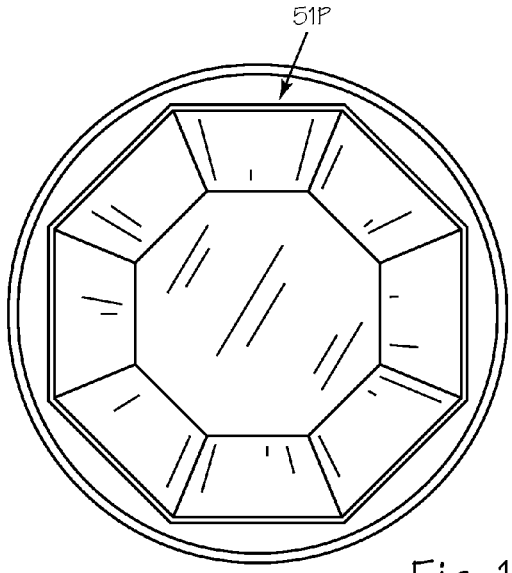
FIG. 11 is an end view of the proximal end of a compression pad with an extension corresponding to the plunger adapter of FIG. 9.

Referring now to FIGS. 9, 10 and 11, plunger adapter 50, and compression pad 51 may adopt any suitable shape. Here, distal end 50D of plunger adapter 50 is octagonal although any suitable regular or irregular shape may be used. Distal end 50D includes socket 52 to engage proximal end 51P of compression pad 51. The distal end of compression pad 51, end 51D, may adopt any suitable shape regardless of the shape of the key on proximal end 51P. Here, proximal end 51P is keyed as a hexagon to conform to the shape of socket 52.

Figure 12:
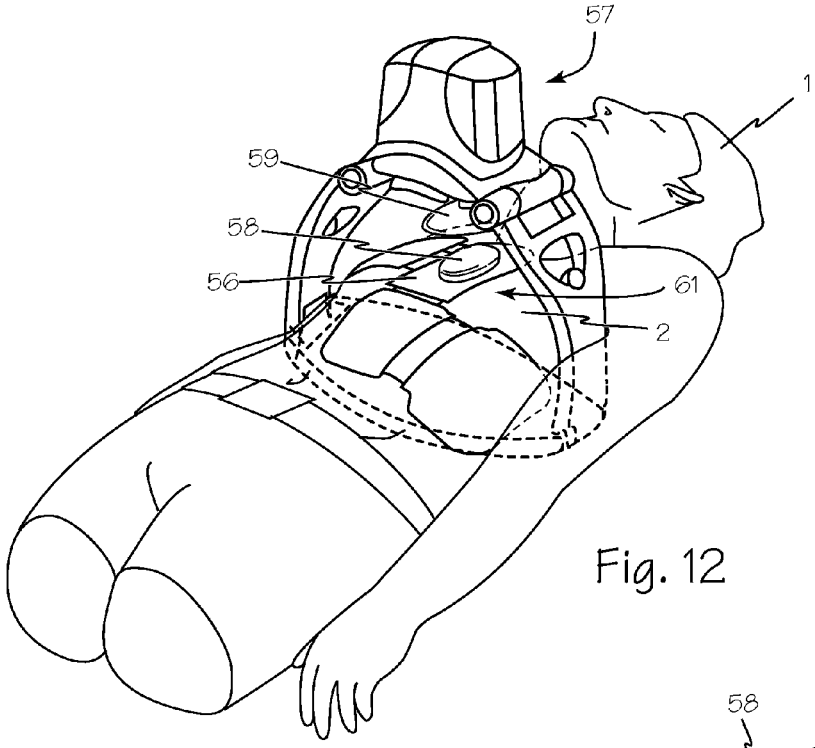
FIG. 12 is a perspective view of a mechanical chest compression device engaging a patient with an electrode assembly and a compression monitor puck.
Figure 13:
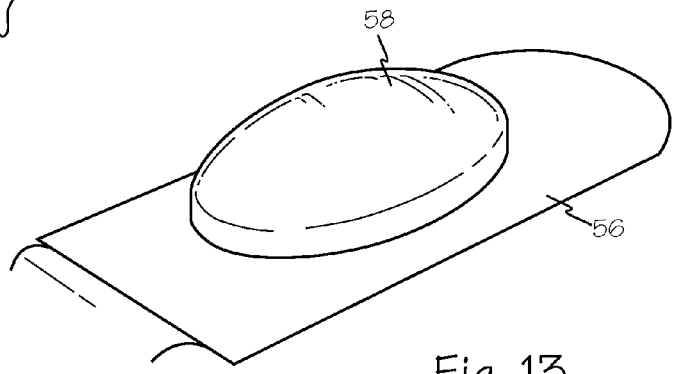
FIG. 13 is a close up perspective of the electrode assembly and compression monitor puck of FIG. 12.

Patient 1 illustrated in FIG. 12 has electrode assembly 56 secured to chest 2. Mechanical chest compression device 57 is oriented to apply compressions to the chest of patient 1. Compression pad 56 includes chest compression monitor 58 used to provide feedback for manual CPR which is illustrated in greater detail in FIG. 13. The chest compression monitor is provided to detect compression depth and or rate according to Halperin, CPR Chest Compression Monitor, U.S. Pat. No. 6,390,996 issued May 21, 2002 incorporated herein by reference.

Figure 14:
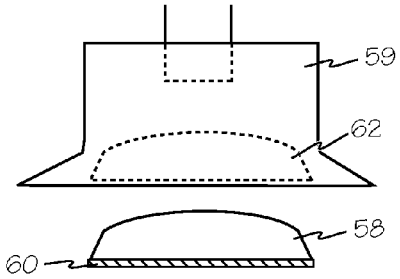
FIG. 14 is a side view of a plunger adapter configured to engage a compression monitor puck.

Plunger adapter 59 is sized and shaped to accommodate socket 62 which engages chest compression monitor or puck 58 as illustrated in FIG. 14. Chest compression monitors may also be separate and stand-alone from a compression pad and are known in the art as a puck. Stand-alone pucks may be adhered to the patient's chest, using adhesive 60 at the desired location 61, for providing feedback for therapeutic chest compressions. An appropriately sized and shaped plunger adapter having a suitably sized and shaped socket 62 may be connected to the plunger of mechanical chest compression device 57 to prevent chest compression device from wandering, walking or otherwise providing chest compressions away from the desired location as discussed above. The plunger adapter is keyed to the size and shape of the puck and may be provided to accommodate pucks or chest compression monitors from any suitable manufacturer operating with any suitable sensor technology or combination of sensors such as accelerometers and or force sensors.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. An automated chest compression device comprising:

a mounting structure;

a chest compression unit including a reversible electromotor, a plunger having a distal end and a proximal end, the proximal end of the plunger operably coupled to the reversible electromotor, the distal end of the plunger extending from and withdrawing into the housing, the chest compression unit secured to the mounting structure to engage a patient and perform chest compressions;

an electromotor control unit operably connected to the motor and including a microprocessor to control the electromotor and the plunger;

a plunger adapter secured to the distal end of the plunger;

a compression pad removably engaging the plunger adapter;

wherein the plunger adapter and the compression pad include complimentary concave and convex elements, respectively, to removably engage the plunger adapter with the compression pad;

a compression monitor secured to the patient at a preselected force application location; and wherein the concave element in the plunger adapter is a socket sized to engage the compression monitor during cyclic chest compressions.

2. The automated chest compression device of claim 1 further comprising:

a electrode assembly secured to the patient corresponding to the preselected force application location; and the compression monitor is removably secured to the electrode assembly.

3. A piston based chest compression device for compressing the chest of a patient having a compression monitor puck secured to the patient's chest, the device comprising:

a support structure;

a chest compression unit apposing the patient's chest, the chest compression unit including a motor, a plunger having a distal end and a proximal end, the proximal end of the plunger operably coupled to the motor, the distal end of the plunger extending from and withdrawing into the compression unit to perform cyclic chest compressions at a preselected force application location;

a microprocessor to control the motor and the plunger; and a plunger adapter having a proximal end and a distal end, the proximal end secured to the distal end of the plunger, the distal end having a concave socket keyed to the size and shape of the compression monitor puck.

* * * * *